US006993485B2

(12) United States Patent
Ferragut, II et al.

(10) Patent No.: US 6,993,485 B2
(45) Date of Patent: Jan. 31, 2006

(54) METHOD AND SYSTEM FOR REFRIGERATOR WITH INTEGRATED PRESENTATION MODE

(75) Inventors: Nelson J. Ferragut, II, Williamsburg, IA (US); John L. McNamara, Coralville, IA (US)

(73) Assignee: Maytag Corporation, Newton, IA (US)

( * ) Notice: Subject to any disclaimer, the term of this patent is extended or adjusted under 35 U.S.C. 154(b) by 327 days.

(21) Appl. No.: 10/195,204

(22) Filed: Jul. 15, 2002

(65) Prior Publication Data

US 2003/0014259 A1 Jan. 16, 2003

Related U.S. Application Data

(60) Provisional application No. 60/305,691, filed on Jul. 16, 2001.

(51) Int. Cl.
*G10L 21/00* (2006.01)

(52) U.S. Cl. ..... 704/270; 62/126; 725/42

(58) Field of Classification Search ..... 704/270; 62/126; 725/42

See application file for complete search history.

(56) References Cited

U.S. PATENT DOCUMENTS

| | | | | |
|---|---|---|---|---|
| 2,517,181 | A | 8/1950 | Davis | |
| 3,836,221 | A | 9/1974 | Whistler, Jr. et al. | |
| 4,117,461 | A | 9/1978 | Kiebala | |
| 4,670,798 | A | 6/1987 | Campbell et al. | |
| 4,984,098 | A | 1/1991 | Buntsis | |
| 5,387,108 | A | 2/1995 | Crowell | |
| 5,903,869 | A | 5/1999 | Jacobson et al. | |
| 6,170,273 | B1 | 1/2001 | Bosi | |
| 6,546,741 | B2 * | 4/2003 | Yun et al. | 62/125 |
| 6,601,394 | B2 * | 8/2003 | Tatter | 62/127 |
| 6,717,522 | B1 * | 4/2004 | Nagatomo et al. | 340/815.4 |
| 6,729,144 | B1 * | 5/2004 | Kupferman | 62/3.6 |
| 6,842,721 | B2 * | 1/2005 | Kim et al. | 702/188 |

FOREIGN PATENT DOCUMENTS

| | | |
|---|---|---|
| EP | 0 421 941 A1 | 2/1990 |
| EP | 1 039 441 A2 | 9/2000 |
| EP | 1 039 441 A3 | 9/2000 |
| EP | 1 079 360 A1 | 2/2001 |
| WO | WO 97/50045 | 12/1997 |
| WO | WO 98/44477 | 10/1998 |

* cited by examiner

*Primary Examiner*—Daniel Abebe
(74) *Attorney, Agent, or Firm*—McKee, Voorhees & Sease, P.L.C.

(57) ABSTRACT

A method and system for a refrigerator having an integrated presentation mode is disclosed. The refrigerator includes a cabinet, a refrigerating compartment disposed within the cabinet, a display operatively connected to the cabinet, an intelligent control electrically connected to the display, wherein the intelligent control is adapted to provide a product message related to the refrigerator on the display. The method includes providing a refrigerator adapted for communicating an audio-visual message containing product information about the refrigerator, playing an audio portion of the message, and displaying a visual portion of the message.

28 Claims, 5 Drawing Sheets

METHOD AND SYSTEM FOR REFRIGERATOR WITH INTEGRATED PRESENTATION MODE

PRIORITY STATEMENT

This application claims priority to U.S. Provisional Patent Application Ser. No. 60/305,691 filed on Jul. 16, 2001, herein incorporated by reference in its entirety.

BACKGROUND OF THE INVENTION

The present invention relates to refrigerators. More particularly, the present invention relates to refrigerators having an integrated presentation mode that is used to play audio-visual messages.

Refrigerators store food as their primary function. Yet, modem day refrigerators can have numerous additional features that can serve as major selling points of the refrigerator. Sales personnel who sell the refrigerators may not always be aware of these features, thus cannot communicate this information to potential buyers. Also, potential buyers may simply not want to talk with sales personnel. Information about the refrigerators can be posted or otherwise made available to potential buyers, but potential buyers will not necessarily read this information. Furthermore, printed information about operation of a refrigerator is easily separated from the refrigerator, both on the show room floor, of after the refrigerator has been purchased and installed.

Therefore, it is a primary object of the present invention to improve upon the state of the art.

It is a further object of the present invention to provide a refrigerator capable of presenting information to potential buyers or a user about the refrigerator.

Another object of the present invention is to provide a refrigerator that presents information about a refrigerator after interest has been expressed in the refrigerator.

Yet another object of the present invention to provide a refrigerator capable of playing audio-visual messages.

These and/or other objects, features, and/or advantages of the present invention will be apparent from the following specification and claims.

SUMMARY OF THE INVENTION

The present invention provides for an appliance, such as a refrigerator, adapted for communicating a presentation. According to one aspect of the present invention, a refrigerator includes a cabinet, a refrigerating compartment disposed within the cabinet, a display operatively connected to the cabinet, an intelligent control electrically connected to the display, the intelligent control being adapted to provide a product message related to the refrigerator on the display.

According to another aspect of the present invention, the invention provides for a method for providing product information. The method includes the steps of providing a refrigerator adapted for communicating an audio-visual message containing product information about the refrigerator, playing an audio portion of the message, and displaying a visual portion of the message. The message can be about functions of the refrigerator or other selling points of the refrigerator or about how to properly use the refrigerator.

Another aspect of the present invention provides for a refrigerator that includes a cabinet for enclosing a refrigerating compartment, the cabinet having a door for providing access to the refrigerating compartment, a display operatively connected to the cabinet, an intelligent control electrically connected to the display, a speaker operatively connected to the intelligent control, and the intelligent control being adapted to provide an audio visual presentation about the refrigerator.

DETAILED DESCRIPTION OF THE DRAWINGS

Figure 1:
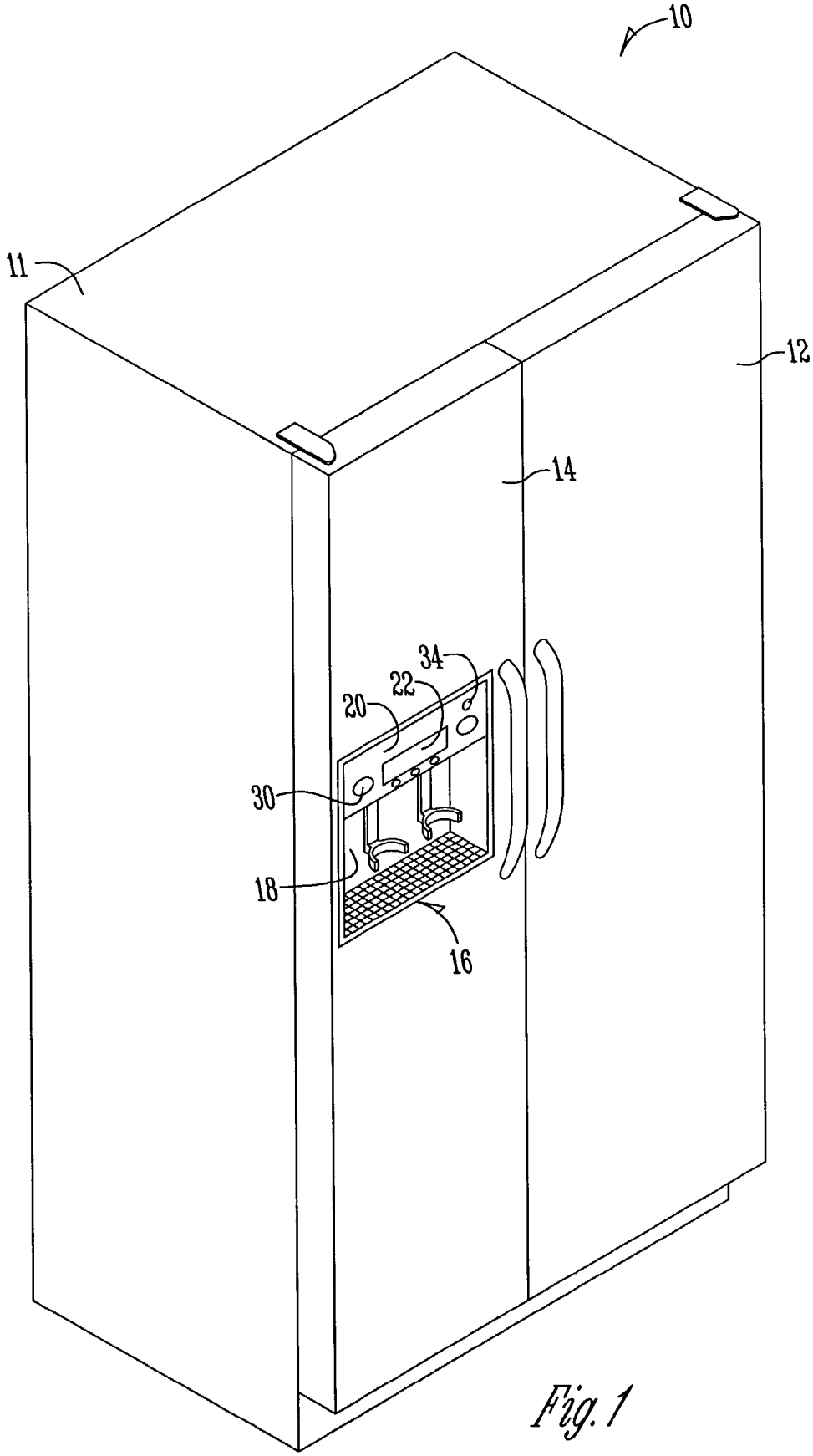
FIG. 1 is a perspective view of one embodiment of a refrigerator of the present invention.

FIG. 1 provides a perspective view of a refrigerator 10 having a side by side configuration. The refrigerator 10 includes a housing or cabinet 11. There is a refrigeration compartment door 12 and a freezer compartment door 14 to provide access to compartments within the cabinet 11. The freezer compartment door 14 contains a water and ice dispenser, generally shown at 16. The water and ice dispenser 16 include a lower receptacle 18 for receiving cups and dispensing water and ice. Above the receptacle 18 is a user interface panel 20. The panel 20 includes a display 22, one or more manual inputs such as button 30, and an LED 34.

Figure 2:
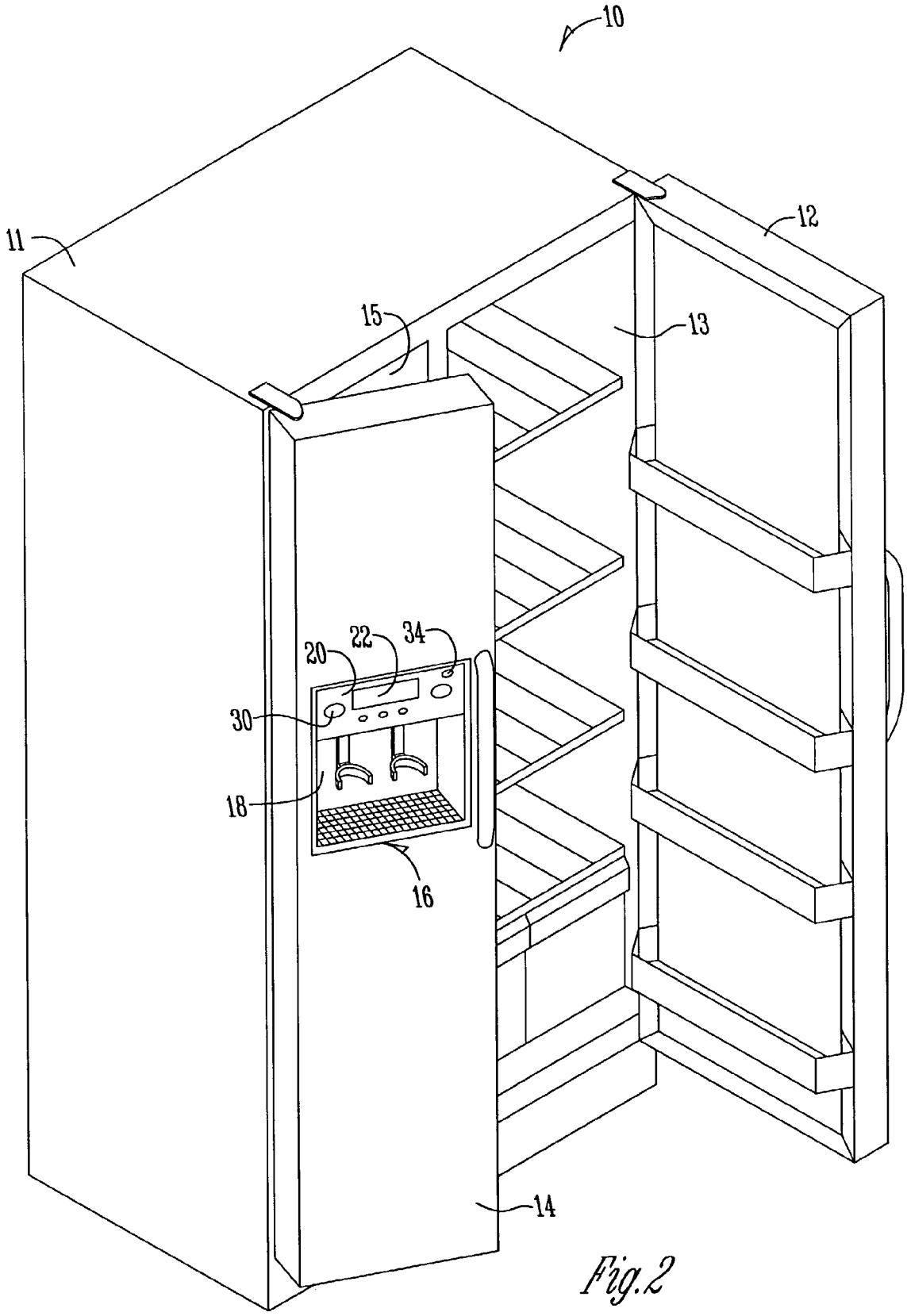
FIG. 2 is a perspective view of the embodiment of FIG. 1 showing the refrigerator with the doors open.

FIG. 2 illustrates the refrigerator 10 with an open refrigeration compartment door 12 and an open freezer compartment door 14. The open refrigeration compartment door 12 exposes the refrigeration compartment 13 within the cabinet 11. The open freezer door 14 exposes the freezer compartment 15 within the cabinet 11. As used herein the term "refrigerating compartment" can refer to either a refrigeration compartment or a freezer compartment. Although it is preferable to place the user interface panel 20 and receptacle 16 in the freezer compartment door 14, the present invention is not limited to any particular placement of either the water and ice dispenser 16 or the user interface panel 20 or the various elements of the user interface panel 20.

Figure 3A:
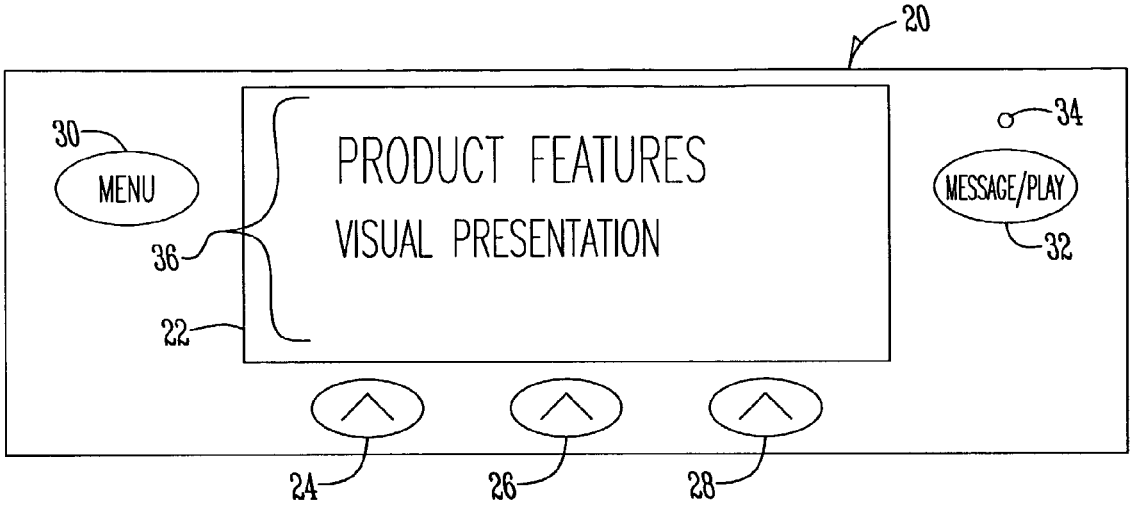
FIG. 3A is a diagram of a user interface according to one embodiment of the present invention where the display illustrates a visual portion of a presentation about the refrigerator.

FIG. 3A shows one view of the user interface panel 20. The user interface panel 20 includes a plurality of manual inputs, including buttons 24, 26, and 28 as well as a menu button 30 and a message/play button 32. The message/play button 32 and the LED 34 are used in conjunction with an electronic message center used to store and retrieve audio messages. Where the electronic message center is used to record audio messages, a microphone (not shown) is also used. The display 22 is adapted for displaying a visual presentation portion 36 of a product message. The product message can be about various features of the refrigerator 10, how to operate the refrigerator 10, or other information related to the refrigerator 10. A speaker (not shown in FIG.

3A) can provide for an audio portion of the presentation such that the presentation about the refrigerator is an audio-visual presentation. The visual portion 36 of the presentation can include text, graphics, and can be an animation. For example, the visual portion 36 can be an animation showing how different features of the refrigerator 10 operate or are used.

Figure 3B:
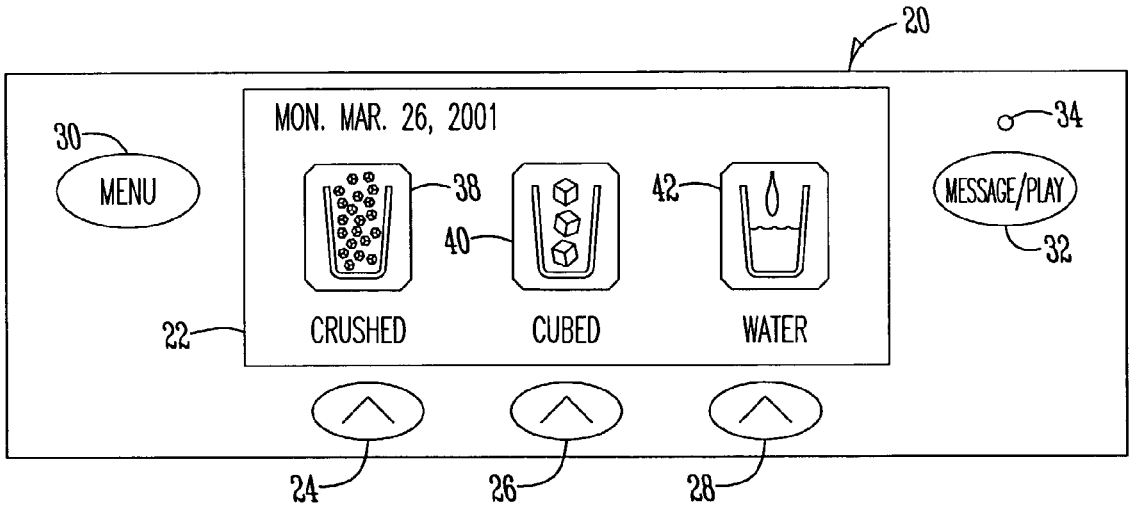
FIG. 3B is a diagram of a user interface according to one embodiment of the present invention where the display illustrates water and ice dispensement refrigerator functions.
Figure 3C:
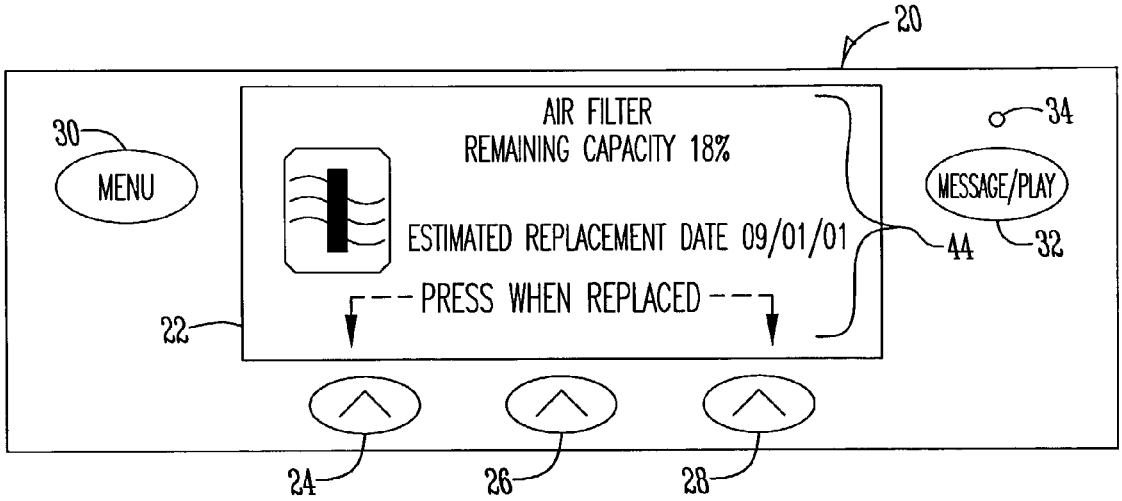
FIG. 3C is a diagram of a user interface according to one embodiment of the present invention where the display illustrates air filter replacement information.
Figure 3D:
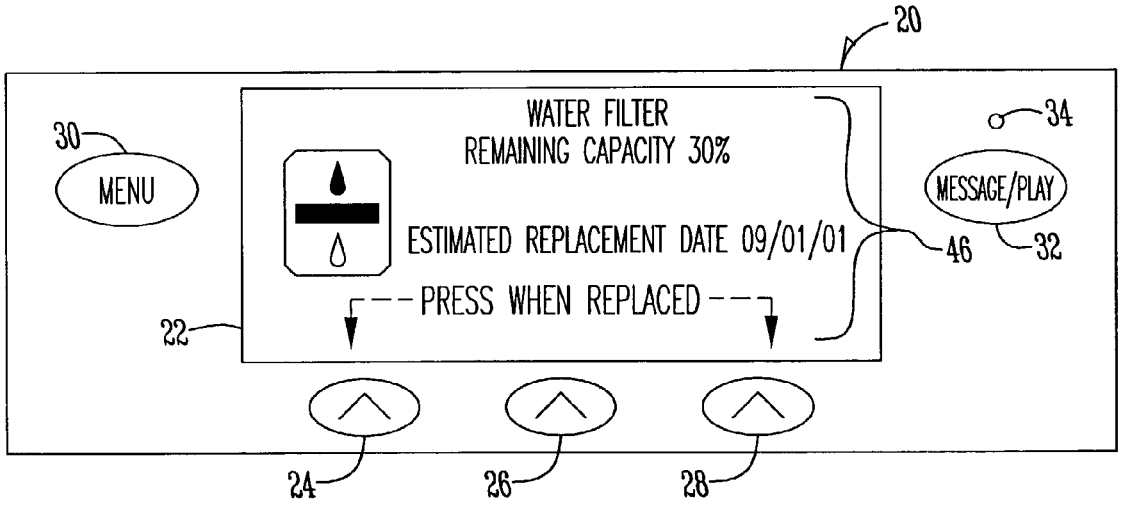
FIG. 3D is a diagram of a user interface according to one embodiment of the present invention where the display illustrates water filter replacement information.

FIGS. 3B–3D show how the display 22 need not be solely used for the audio-visual presentation. Preferably, the display 22 is also adapted for displaying refrigerator operation information. In FIG. 3B, three icons are present. A first icon 38 is associated with dispensement of crushed ice. A second icon 40 is associated with dispensement of cubed ice. A third icon 42 is associated with dispensement of water. Each of the icons 38, 40, and 42 and its associated function is also associated with one of the buttons 24, 26, and 28, respectively such that pressing one of the buttons 24, 26, and 28, results in performing the associated refrigerator function. As shown, each of the icons 38, 40, and 42 also includes a textual label beneath it, "CRUSHED", "CUBED", and "WATER", respectively. The menu button 30 can be used to display any number of screens. Preferably, the use of the manual input buttons 24, 26, 28 is menu-driven so that the buttons allow for the selection of different functions based upon the currently displayed information on the display 22. Other display screens can provide for selecting a language in which to display information, setting date and time information, adjusting volume information, setting a timer, checking the status of a water filter, checking the status of an air filter, or other refrigerator functions.

FIG. 3C illustrates another embodiment of the display 22 of the user interface panel 20 which is adapted to provide a user interface for air filter replacement. The display 22 includes air filter information 44. This information 44 can include the remaining capacity of an air filter and/or an estimated replacement date. Thus, the display 22 provides for the display of refrigerator operation information in addition to a visual presentation 36 (FIG. 3A) about refrigerator information.

FIG. 3D illustrates another embodiment of the display 22 of the user interface panel 20 being adapted to provide a user interface for water filter replacement. The display 22 includes water filter information 46. This information can include the remaining capacity of a water filter, an estimated order date by which the water filter should be ordered in order to obtain it prior to an estimated replacement date, and/or the estimated replacement date. This is another example of how the display 22 provides for the display of refrigerator operation information in addition to being used to provide for displaying a visual portion 36 (FIG. 3A) of a product message.

Figure 4:
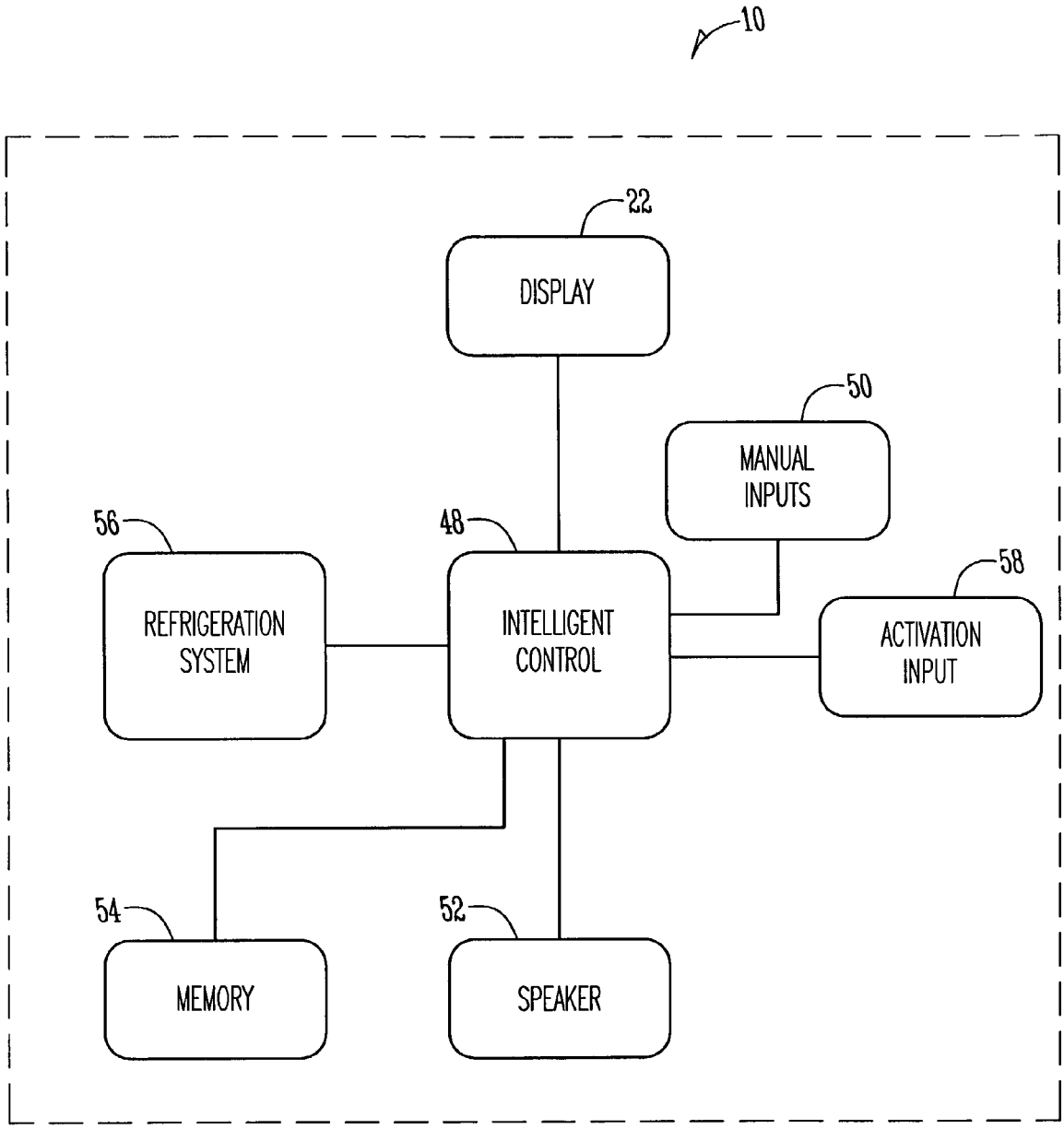
FIG. 4 is a block diagram of one embodiment of the present invention.

FIG. 4 provides a block diagram illustrating structure of the present invention. The refrigerator 10 includes an intelligent control 48. The intelligent control 48 preferably includes a microcontroller or microprocessor, or application specific integrated circuit (ASIC), however, the present invention contemplates that any type of intelligent control can be used as may be appropriate in a particular design. The intelligent control 48 is electrically connected to a display 22. The display 22 can be used to display either refrigerator operations or functions or messages about the refrigerator including sales messages, product information messages, or promotional messages. Preferably, the display 22 is a LCD panel type display, however, the present invention contemplates that other types of displays may be used, such as may be appropriate or desirable in a particular application.

The intelligent control 48 is also electrically connected to manual inputs 50. The manual inputs 50 can include the buttons 24, 26, 28, 30, and 32 (as shown in FIGS. 3A–3D). The manual inputs 50 need not be separate buttons, but can be incorporated into a touch screen display, or otherwise provided. The intelligent control 48 can also be used to control refrigerator functions. The intelligent control 48 is electrically connected to the refrigeration system 56 such that the intelligent control 48 can control the dispensement of ice, the dispensement of water, or other refrigerator functions. The intelligent control 48 is also electrically connected to a speaker 52 which is used to play an audio portion of a presentation. The intelligent control 48 is also electrically connected to a memory 54. The memory 54 is used to store one or more audio portions or visual portions of a product presentation. The present invention contemplates that more than one type of memory can be used. For example, the audio portion of the presentation can be stored on an integrated circuit from Integrated Storage Devices, Inc. (ISD) that can be a part of the intelligent control 48, while the visual portion of the presentation can be stored in a separate memory associated with a microcontroller or processor. The present invention contemplates that the visual portion of the presentation can include an animation.

An activation input 58 is also shown that is electrically connected to the intelligent control 48. The activation input 58 can be a switch associated with a door of a refrigerating compartment. When potential buyers are examining refrigerators on the showroom floor, they may open the door of a refrigerator or otherwise express interest in a particular refrigerator. When the activation input 58 is associated with a door of the refrigerator, the intelligent control 48 is adapted to start playing a presentation upon the opening of the door. Thus, the presentation is only played once a potential buyer has expressed interest in the refrigerator. The present invention also contemplates that the activation input 58 can be otherwise located and may be used for other purposes as well when the refrigerator is not within a sales or presentation mode.

For example, the activation input 58 can be associated with the ice dispenser such that when the refrigerator is in a presentation mode, instead of dispensing ice, the refrigerator provides information about ice dispensing features of the refrigerator. Thus the present invention can determine a user or potential buyer's interest in the refrigerator or particular features of the refrigerator and can select an appropriate presentation based on the interest expressed. The present invention further contemplates that the activation input 58 can be a switch associated with a proximity detector such that when a person walks by the refrigerator, the presentation begins. The intelligent control 48 can also include a timer so that the presentation can be restarted after a duration of time. When the refrigerator is displayed on a showroom floor, it may be desirable to play the presentation periodically instead of sensing the interest of a user by their passing by the refrigerator, opening a door, or using a particular feature of the refrigerator.

Thus, a refrigerator having an integrated presentation mode has been disclosed. The present invention contemplates variations including the type of display, the type of refrigerator functions performed, the placement of the display, the number and placement of manual inputs, the manner in which a particular presentation is selected, the content of presentations, and other variations within the spirit and scope of the invention. Also, the user interface panel can be incorporated into other appliances and be used in conjunction with the functions of a particular appliance.

What is claimed is:

1. A refrigerator comprising:

a cabinet;

a refrigerating compartment disposed within the cabinet;

a display operatively connected to the cabinet;

an intelligent control electrically connected to the display; and wherein the intelligent control is adapted to provide a product message related to the refrigerator on the display and is adapted to control refrigerator functions.

2. The refrigerator of claim 1 further comprising a speaker electrically connected to the intelligent control and wherein the product message further includes audio content and wherein the intelligent control is adapted to play the audio content over the speaker.

3. The refrigerator of claim 1 further comprising a switch electrically connected to the intelligent control for initiating the product message.

4. The refrigerator of claim 3 wherein the switch is associated with a door of the cabinet such that opening the door initiates the product message.

5. The refrigerator of claim 1 wherein the intelligent control includes a timer.

6. The refrigerator of claim 1 further comprising at least one manual input electrically connected to the intelligent control.

7. The refrigerator of claim 1 wherein the product message includes an animation.

8. The refrigerator of claim 1 wherein the product message is an informational message describing a feature of the refrigerator.

9. A method for providing product information, comprising:

providing a refrigerator with a user interface adapted for controlling refrigerator functions and communicating an audio-visual message containing product information about the refrigerator;

playing an audio portion of the message; and displaying a visual portion of the message.

10. The method of claim 9 wherein the refrigerator includes a display and a speaker.

11. The method of claim 9 further comprising determining an occurrence of an event associated with user interest in the refrigerator.

12. The method of claim 9 wherein the step of playing is playing the audio portion of the message upon the occurrence of the event.

13. The method of claim 9 wherein the step of displaying is displaying the visual portion of the message upon the occurrence of the event.

14. The method of claim 9 wherein the event is opening of a door of the refrigerator.

15. A refrigerator comprising:

a cabinet for enclosing a refrigerating compartment, the cabinet having a door for providing access to the refrigerating compartment;

a display operatively connected to the cabinet;

an intelligent control electrically connected to the display;

a speaker operatively connected to the intelligent control;

wherein the intelligent control is adapted to control refrigerator functions and further adapted to provide an audio visual presentation about the refrigerator.

16. The refrigerator of claim 15 wherein the intelligent control is adapted to provide the audio visual presentation upon activation of a switch electrically connected to the intelligent control.

17. The refrigerator of claim 16 wherein the switch is associated with the door.

18. The refrigerator of claim 15 wherein the intelligent control includes a timer and the intelligent control is adapted to replay the audio visual presentation after a duration of time associated with the timer.

19. A refrigerator comprising:

a cabinet;

a refrigerating compartment disposed within the cabinet;

an intelligent control electrically connected to a display;

a memory in operative communication with the intelligent control, the memory storing a product message related to the refrigerator for displaying on the display;

a refrigeration system disposed within the cabinet and operatively connected to the intelligent control;

wherein the intelligent control is adapted for initiating an integrated presentation containing the product message and for controlling refrigerator functions through control of the refrigeration system.

20. The refrigerator of claim 19 further comprising a speaker electrically connected to the intelligent control and wherein the product message further includes audio content and wherein the intelligent control is adapted to play the audio content over the speaker.

21. The refrigerator of claim 19 further comprising a switch electrically connected to the intelligent control for initiating the product message.

22. The refrigerator of claim 21 wherein the switch is associated with a door of the cabinet such that opening the door initiates the product message.

23. The refrigerator of claim 19 wherein the intelligent control includes a timer.

24. The refrigerator of claim 19 further comprising at least one manual input electrically connected to the intelligent control.

25. The refrigerator of claim 19 wherein the product message includes an animation.

26. The refrigerator of claim 19 wherein the product message is an informational message describing a feature of the refrigerator.

27. The refrigerator of claim 19 wherein the intelligent control is adapted to provide the audio visual presentation upon activation of a switch electrically connected to the intelligent control.

28. The refrigerator of claim 19 wherein the intelligent control includes a timer and the intelligent control is adapted to replay the audio visual presentation after a duration of time associated with the timer.

* * * * *